US009319809B2

(12) United States Patent
Sohn et al.

(10) Patent No.: US 9,319,809 B2
(45) Date of Patent: Apr. 19, 2016

(54) HEARING LOSS COMPENSATION APPARATUS INCLUDING EXTERNAL MICROPHONE

(71) Applicant: SAMSUNG ELECTRONICS CO., LTD., Suwon-si (KR)

(72) Inventors: Jun Il Sohn, Yongin-si (KR); Dong Wook Kim, Seoul (KR); Sang Wook Kim, Seoul (KR); Jong Min Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/287,422

(22) Filed: May 27, 2014

(65) Prior Publication Data

US 2015/0078602 A1 Mar. 19, 2015

(30) Foreign Application Priority Data

Sep. 16, 2013 (KR) ..... 10-2013-0111430

(51) Int. Cl.
*H04R 25/00* (2006.01)

(52) U.S. Cl.
CPC ..... *H04R 25/604* (2013.01); *H04R 25/405* (2013.01); *H04R 2460/17* (2013.01)

(58) Field of Classification Search
CPC ..... H04R 25/30; H04R 25/305; H04R 2225/023; H04R 2460/17; H04R 25/40; H04R 25/43
See application file for complete search history.

(56) References Cited

U.S. PATENT DOCUMENTS

| | | | | |
|---|---|---|---|---|
| 5,395,168 | A * | 3/1995 | Leenen | H04R 25/456 379/52 |
| 5,875,257 | A * | 2/1999 | Marrin et al. | G06F 3/0346 382/107 |
| 8,081,769 | B2 * | 12/2011 | Fukuda et al. | H04R 3/02 381/71.6 |
| 8,331,593 | B2 * | 12/2012 | Slemming et al. | H04R 25/646 381/318 |
| 8,374,367 | B2 * | 2/2013 | Nielsen et al. | H04R 25/658 381/313 |
| 8,577,067 | B2 * | 11/2013 | Michel et al. | H04R 25/606 381/322 |
| 2001/0043708 | A1 * | 11/2001 | Brimhall | H04R 25/456 381/328 |
| 2007/0160242 | A1 * | 7/2007 | Cadalli et al. | H04R 25/70 381/312 |
| 2009/0092269 | A1 | 4/2009 | Nielsen et al. | |
| 2012/0076313 | A1 * | 3/2012 | Junius et al. | H04R 25/70 381/60 |

* cited by examiner

*Primary Examiner* — Curtis Kuntz
*Assistant Examiner* — Ryan Robinson
(74) *Attorney, Agent, or Firm* — NSIP Law

(57) ABSTRACT

A hearing loss compensation apparatus includes a microphone configured to collect an ambient sound and generate an audio signal based on the collected ambient sound. A hearing loss compensation apparatus body inserted into an ear of a hearing impaired patient is configured to compensate for the audio signal based on auditory characteristics of the hearing impaired patient. The hearing loss compensation apparatus body is further configured to output the audio signal in a direction of an eardrum of the hearing impaired patient. A connection member is configured to connect the microphone to the hearing loss compensation apparatus body and fix a position of the microphone to be inside an ear canal of the hearing impaired patient.

16 Claims, 4 Drawing Sheets

HEARING LOSS COMPENSATION APPARATUS INCLUDING EXTERNAL MICROPHONE

CROSS-REFERENCE TO RELATED APPLICATION(S)

This application claims the benefit under 35 U.S.C. §119 (a) of Korean Patent Application No. 10-2013-0111430, filed on Sep. 16, 2013, in the Korean Intellectual Property Office, the entire disclosure of which is incorporated herein by reference.

BACKGROUND

1. Field

The present invention relates to a hearing loss compensation apparatus including an external microphone.

2. Description of the Related Art

A hearing loss compensation apparatus compensates for an ambient sound that a hearing impaired patient may be unable to perceive, and then provides the ambient sound to the hearing impaired patient such that the hearing impaired patient may normally perceive the ambient sound. In this instance, the hearing loss compensation apparatus may be an internal battery operated and; thus, technology to reduce power consumption of the battery may be required.

Recently, a hearing loss compensation apparatus inserted into an ear canal of the hearing impaired patient is being developed such that the apparatus is concealed within the ear canal to avoid revealing to other people that the hearing loss compensation apparatus is worn by the hearing impaired patient.

In this instance, when a size of the hearing loss compensation apparatus inserted into the ear canal of the hearing impaired patient is reduced, the hearing loss compensation apparatus may be inserted deeper into the ear canal. As a result, the hearing loss compensation apparatus may be disposed closer to an eardrum of the hearing impaired patient.

The smaller a distance between the hearing loss compensation apparatus and the eardrum, the lower an amount of power required to output a sound to be sufficiently perceived by the hearing impaired patient.

Accordingly, there is a desire for a method or an apparatus including a configuration to reduce a size of the hearing loss compensation apparatus.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative configuration, there is provided a hearing loss compensation apparatus including a hearing loss compensation apparatus body inserted into an ear of a patient, and configured to compensate for an audio signal from a microphone based on auditory characteristics of the patient, and output the audio signal towards an eardrum of the patient; and a connection member configured to connect the microphone to the hearing loss compensation apparatus body.

The microphone may be configured to collect an ambient sound and generate the audio signal based on the collected ambient sound.

The connection member may include a straight shape and is formed of a nonflexible material.

The connection member may be formed to have a length to prevent the microphone from protruding from an ear canal when the hearing loss compensation apparatus body is inserted into the ear of the patient.

The connection member may be formed using a material having a strength sufficient to prevent the microphone from touching an ear canal due to wobbling caused by a movement of the patient.

The microphone may be provided in a shape to enable the patient to grip the hearing loss compensation apparatus body to insert or remove the hearing loss compensation apparatus body.

In accordance with another illustrative configuration, there is provided a hearing loss compensation apparatus, including a connection member operatively connected to a microphone and configured to transfer an audio signal received from the microphone; and a hearing aid compensation body configured to compensate the audio signal based on auditory characteristics of a user, and output the audio signal in a direction of an ear drum of the user, wherein the microphone is external to the hearing aid compensation body.

The connection member may include a length to prevent the microphone from protruding from the ear canal.

In accordance with an alternative illustrative configuration, there is provided a hearing aid body of a hearing aid compensation apparatus, including a signal compensation unit configured to compensate by a factor an audio signal received from an external microphone and to amplify the audio signal for each frequency band based on auditory characteristics of the user, wherein the factor is based on a distance between the hearing loss compensation apparatus body and an eardrum; and a signal output unit configured to output the compensated audio signal from the signal compensation unit.

The signal compensation unit may be further configured to compensate the audio signal collected at the external microphone by amplifying the audio signal at each frequency band based on auditory characteristics of the user.

The signal compensation unit may extract information from the audio signal to measure a distance between the hearing loss compensation apparatus body and the eardrum.

The hearing loss compensation apparatus body may receive audio signals from microphones external to the hearing aid body through combination with connection members.

Other features and aspects may be apparent from the following detailed description, the drawings, and the claims

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

Figure 1:
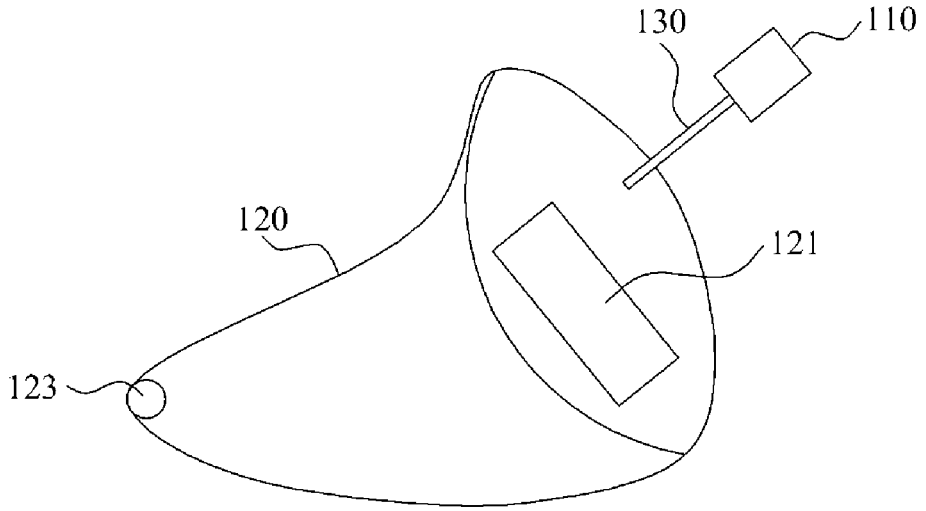
FIG. 1 is a diagram illustrating an example of a hearing loss compensation apparatus, according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

It will be understood that when an element or layer is referred to as being "on" or "connected to" another element or layer, it can be directly on or connected to the other element or layer or through intervening elements or layers may be present. In contrast, when an element is referred to as being "directly on" or "directly connected to" another element or layer, there are no intervening elements or layers present. Like reference numerals refer to like elements throughout.

FIG. 1 is a diagram illustrating an example of a hearing loss compensation apparatus, according to an embodiment.

Referring to FIG. 1, the hearing loss compensation apparatus includes a microphone 110, a hearing loss compensation apparatus body, shell, or case 120, and a connection member 130.

The microphone 110 collects an ambient sound and generates an audio signal based on the collected ambient sound. Also, the microphone 110 transfers the generated audio signal to the hearing loss compensation apparatus body 120 using the connection member 130.

In addition, a configuration of the microphone 110 may be in a shape that would enable the hearing impaired patient to grip the hearing loss compensation apparatus body 120 during insertion or removal.

The hearing loss compensation apparatus body 120 is inserted into the ear of the hearing impaired patient. The hearing loss compensation apparatus body 120 receives an audio signal through the microphone 110 to compensate the audio signal based on auditory characteristics of the hearing impaired patient, and then outputs the audio signal in a direction of an ear drum of the hearing impaired patient.

In this example, the hearing loss compensation apparatus body 120 includes at least one of a battery door 121 to insert a battery to supply power used to drive the hearing loss compensation apparatus body 120. A face plate is in contact with an ear canal of the hearing impaired patient to fix a position of the hearing loss compensation apparatus body 120. A speaker 123 is configured to output an audio signal to the ear drum of the hearing impaired patient for which compensation is performed.

Because the microphone 110 is external to the hearing loss compensation apparatus body 120, a size of the hearing loss compensation apparatus body 120 may be smaller than a size of a hearing loss compensation apparatus including a microphone.

The connection member 130 connects the microphone 110 to the hearing loss compensation apparatus body 120, and fixes the position of the microphone 110 to be inside the ear canal of the hearing impaired patient. In this example, the connection member 120 transfers the audio signal generated by the microphone 110 to the hearing loss compensation apparatus body 120.

In one example, the material may be a flexible material. In an alternative example, the connection member 130 may be configured to have a straight shape and formed using a nonflexible material. In this instance, the connection member 130 may be formed using a material having strength sufficient to prevent the microphone 110 from contacting the ear canal of the hearing impaired patient due to wobbling that may be caused by a movement of the hearing impaired patient. In another alternative, the connection member 130 may be configured to have a flexed or a curved shape and may be formed using a nonflexible or a flexible material.

Also, the connection member 130 may be formed to have a length such that the microphone 110 does not protrude from the ear canal when the hearing loss compensation apparatus body 120 is inserted into the ear of the hearing impaired patient. For example, a length of the connection member 130 may be less than 1.5 centimeters (cm).

Figure 2:
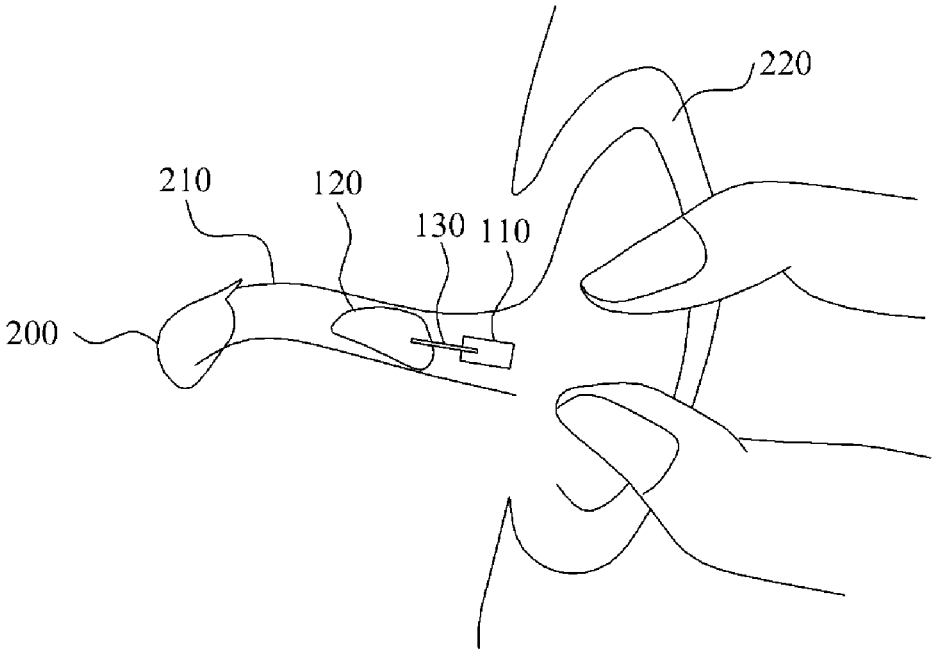
FIG. 2 is a diagram illustrating an ear of a hearing impaired patient wearing a hearing loss compensation apparatus, according to an embodiment.

FIG. 2 is a diagram illustrating an ear of a hearing impaired patient wearing a hearing loss compensation apparatus, according to an embodiment.

Referring to FIG. 2, the hearing impaired patient may grip the microphone 110 using his or her fingers to insert the hearing loss compensation apparatus body 120 into the ear of the hearing loss compensation patient.

In this instance, because the hearing loss compensation apparatus body 120 does not include the microphone 110 integrated therein, a size of the hearing loss compensation apparatus body 120 may be smaller than a size of a hearing loss compensation apparatus including a microphone. Thus, the hearing loss compensation apparatus body 120 may be inserted deeper into an ear canal 210 of the hearing impaired patient when compared to the hearing loss compensation apparatus including a microphone.

A distance between the hearing loss compensation apparatus body 120 and an eardrum 200 decreases when the hearing loss compensation apparatus body 120 is inserted deeper into the ear canal 210.

The hearing impaired patient may sufficiently perceive the audio signal compensated for by the hearing loss compensation apparatus body 120 despite the audio signal being output with a lower intensity because the distance between the hearing loss compensation apparatus body 120 and the eardrum 200 is small.

By not including the microphone 110, the hearing loss compensation apparatus body 120 may be provided in a reduced size to decrease the distance between the hearing loss compensation apparatus body 120 and the eardrum 200. The smaller the distance between the hearing loss compensation apparatus body 120 and the eardrum 200, the lower an amount of power required to output the audio signal to the ear drum of the hearing impaired patient to be sufficiently perceived by the patient. Accordingly, power consumption is reduced at the hearing loss compensation apparatus body 120.

In one configuration, the microphone 110 is disposed inside the ear canal 210 based on a length of the connection member 130. Thus, an ambient sound collected by the microphone 110 may be a sound having received an acoustic effect of the ear canal 210 and a pinna 220 of the hearing impaired patient.

The microphone 110 may be protected from significant amounts of dirt or foreign substances, aside from amounts of foreign substances entering inside the ear canal 210 of the hearing impaired patient, because the microphone 110 is disposed inside the ear canal 210.

As shown in FIG. 2, the connection member 130 ensures that the microphone 110 is at a center of the ear canal 210. However, when the hearing impaired patient walks or runs, a body of the hearing impaired patient shakes. Thus, the hearing loss compensation apparatus body 120 vibrates due to the shaking of the body of the hearing impaired patient.

As a result, when the connection member 130 is formed using a flexible material, the microphone 110 may be shaken and touch the ear canal 210 due to the hearing loss compensation apparatus body 120 wobbling in combination with the connection member 130. Thus, the connection member 130 may be formed using a material that may be flexible that may adjust to the movement of the ear canal 210 and with a strength sufficient to prevent the microphone 110 from touching the ear canal 210 of the hearing impaired patient due to a wobbling caused by a movement of the hearing impaired patient.

Figure 3:
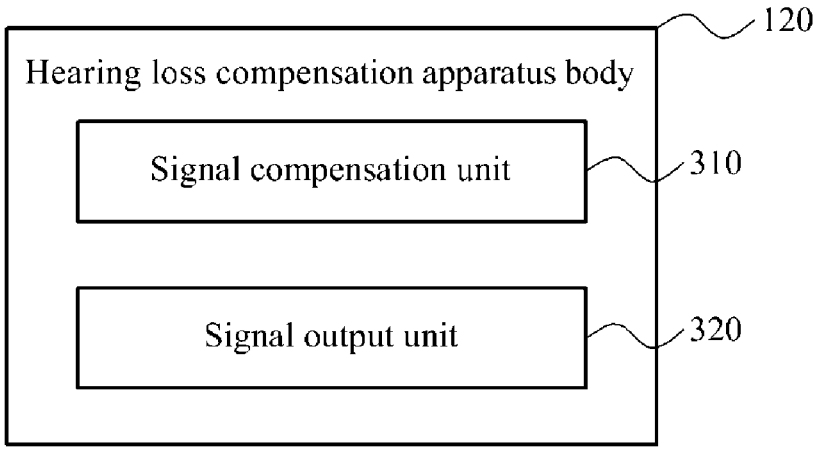
FIG. 3 is a block diagram illustrating a configuration of a hearing loss compensation apparatus, according to an embodiment.

FIG. 3 is a block diagram illustrating a configuration of a hearing loss compensation apparatus, according to an embodiment.

Referring to FIG. 3, the hearing loss compensation apparatus body 120 includes a signal compensation unit 310 and a signal output unit 320.

The signal compensation unit 310 compensates an audio signal, which is generated by collecting an ambient sound using the microphone 110, based on auditory characteristics of the hearing impaired patient. For example, the signal compensation unit 310 compensates the audio signal collected at the microphone 110 by amplifying the audio signal at each frequency band based on auditory characteristics of the hearing impaired patient.

In addition, the signal compensation unit 310 changes a parameter or a factor used to compensate the audio signal based on a distance between the hearing loss compensation apparatus body 120 and an eardrum.

In this example, the signal compensation unit 310 processes a signal from the signal output unit 320, to measure a distance between the hearing loss compensation apparatus body 120 and the eardrum. For instance, the signal compensation unit 310 extracts information from the signal to measure the distance from the audio signal generated at the microphone 110.

Also, the signal compensation unit 310 receives information associated with the distance between the hearing loss compensation apparatus body 120 and the eardrum from the hearing impaired patient or an external area.

The hearing loss compensation apparatus body 120 receives audio signals from a plurality of microphones through combination with a plurality of connection members.

In this example, the signal compensation unit 310 detects a sound generation direction using the plurality of microphones. By compensating for a sound based on the auditory characteristics of the hearing impaired patient corresponding to the detected sound generation direction, the signal compensation unit 310 is configured to correct a sound distorted due to a change in a head related transfer function (HRTF) occurring when the hearing impaired patient wears the hearing loss compensation apparatus body 120. In one illustrative example, the auditory characteristics of the hearing impaired patient may be a three-dimensional equal loudness contour of the hearing impaired patient, which is determined by mapping hearing thresholds corresponding to directional angles and frequencies to a two-dimensional plane constituted by a frequency and a directional angle.

The signal output unit 320 outputs a compensated audio signal produced at the signal compensation unit 310.

Figure 4:
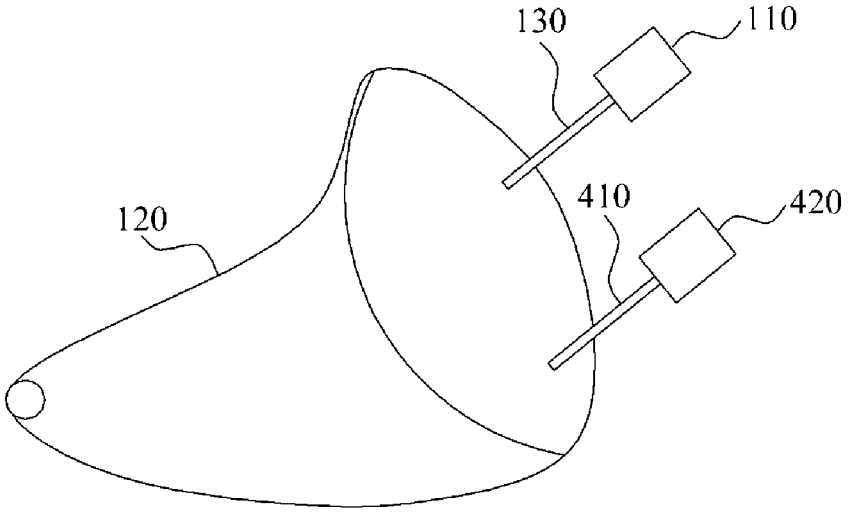
FIG. 4 is a diagram illustrating another example of a hearing loss compensation apparatus, according to an embodiment.

FIG. 4 is a diagram illustrating another example of a hearing loss compensation apparatus, according to an embodiment.

Referring to FIG. 4, the hearing loss compensation apparatus body 120 may be connected to a plurality of microphones.

When a hearing loss compensation apparatus includes a plurality of microphones, a size of the hearing loss compensation apparatus may increase in proportion to a number of the microphones included therein.

Because the hearing loss compensation apparatus body 120 is combined with microphone 110 and microphone 420, configured to be external to the hearing loss compensation apparatus body 120 using the connection member 130, a size of the hearing loss compensation apparatus body 120 may not increase despite an increase in a number of microphones 110 and 420, which generate audio signals and transmit the generated audio signals to the hearing loss compensation apparatus body 120.

For example, as shown in FIG. 4, the hearing loss compensation apparatus body 120 is also combined with a connection member 410 in addition to the connection member 130. In this example, the connection member 410 may be formed using an identical material to the connection member 130, and combined with a microphone 420.

In one configuration, the hearing loss compensation apparatus body 120 receives an audio signal generated by collecting an ambient sound from each of the microphone 110 and the microphone 420. Also, the hearing loss compensation apparatus body 120 identifies a location of a sound source from the ambient sound based on a difference between the audio signal received from the microphone 110 and the audio signal received from the microphone 420.

Comparing the configuration of FIG. 4 with the illustrative configuration of FIG. 1, although the number of microphones for generating an audio signal is increased in the hearing loss compensation apparatus, the hearing loss compensation apparatus body 120 may be additionally combined with the connection member 410 connected to the microphone 420. Also, a size of the hearing loss compensation apparatus body 120 may not be changed as shown in FIG. 4.

Accordingly, in the hearing loss apparatus according to an embodiment, the hearing loss compensation apparatus body 120 may be connected to a plurality of microphones using a plurality of connection members. The hearing loss compensation apparatus body 120 may be configured to receive audio signals from the plurality of microphones and use the received audio signals without a change or a significant change in a size of the hearing loss compensation apparatus body 120 inserted into an ear of the hearing impaired patient.

The units and apparatuses described herein may be implemented using hardware components. The hardware components may include, for example, controllers, sensors, processors, generators, drivers, and other equivalent electronic components. The hardware components may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The hardware components may run an operating system (OS) and one or more software applications that run on the OS. The hardware components also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a hardware component may include multiple processors or a processor and a controller. In addition, different processing configurations are possible, such a parallel processors.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A hearing loss compensation apparatus, comprising:

a hearing loss compensation apparatus body configured for insertion into an ear of a patient, and configured to:

receive an audio signal from a microphone, compensate the audio signal based on auditory characteristics of the patient, and output a compensated audio signal towards an eardrum of the patient; and a connection member configured to connect the microphone to the hearing loss compensation apparatus body, and wherein the auditory characteristics of the patient include a three-dimensional equal loudness contour of the patient which is determined by mapping hearing thresholds to corresponding directional angles and mapping frequencies to a two-dimensional plane constituted by a frequency and a directional angle.

2. The apparatus of claim 1, wherein the microphone is configured to collect an ambient sound and generate the audio signal based on the collected ambient sound.

3. The apparatus of claim 1, wherein the connection member comprises a straight shape and is formed of a nonflexible material.

4. The apparatus of claim 1, wherein the a length of the connection member is such that the microphone does not protrude from an ear canal when the hearing loss compensation apparatus body is inserted into the ear of the patient.

5. The apparatus of claim 1, wherein the connection member is formed using a material having a strength sufficient to prevent the microphone from touching an ear canal due to wobbling caused by a movement of the patient.

6. The apparatus of claim 1, wherein the microphone is provided in a shape to enable the patient to grip the hearing loss compensation apparatus body to insert or remove the hearing loss compensation apparatus body.

7. A hearing loss compensation apparatus, comprising:

a connection member operatively connected to a microphone and configured to transfer an audio signal received from the microphone; and a hearing aid compensation body configured to compensate the audio signal based on auditory characteristics of a user, and to output a compensated audio signal in a direction of an ear drum of the user, wherein the microphone is external to the hearing aid compensation body, and wherein the auditory characteristics of the user include a three-dimensional equal loudness contour of the patient which is determined by mapping hearing thresholds to corresponding directional angles and mapping frequencies to a two-dimensional plane constituted by a frequency and a directional angle.

8. The hearing loss compensation apparatus of claim 7, wherein the connection member comprises a length to prevent the microphone from protruding from the ear canal.

9. A hearing aid body of a hearing aid compensation apparatus, comprising:

a signal compensation unit configured to compensate an audio signal received from an external microphone and to amplify the audio signal for each frequency band based on auditory characteristics of a user; and a signal output unit configured to output the compensated audio signal, wherein the auditor characteristics of the user comprises a three-dimensional equal loudness contour of the user that is determined by mapping hearing thresholds to corresponding directional angles and by mapping frequencies to a two-dimensional plane constituted by a frequency and a directional angle.

10. The hearing aid body of claim 9, wherein the signal compensation unit is further configured to compensate the audio signal by amplifying the audio signal at each frequency band based on the auditory characteristics of the user.

11. The hearing aid body of claim 9, wherein the signal compensation unit is further configured to extract information from the audio signal to measure a distance between the hearing loss compensation apparatus body and the eardrum.

12. The hearing aid body of claim 9, wherein a connection member connects the hearing aid body to the external microphone and the external microphone is disposed outside the hearing aid body.

13. The hearing aid body of claim 12, wherein the signal compensation unit is further configured to detect a sound generation direction using the external microphone.

14. The hearing aid body of claim 9, wherein the signal compensation unit is further configured to correct a sound distorted due to a change in a head related transfer function (HRTF).

15. The hearing aid body of claim 9, wherein the audio signal is compensate by a factor based on a distance between the hearing loss compensation apparatus body and an eardrum of the user.

16. The hearing aid body of claim 9, wherein connection members connect the hearing aid body to a plurality of external microphone and the external microphones are disposed outside the hearing aid body.

* * * * *